US005230196A

United States Patent [19]

Zeigler

[11] Patent Number: 5,230,196

[45] Date of Patent: Jul. 27, 1993

[54] POLYHEDRON BUILDING SYSTEM

[75] Inventor: Theodore R. Zeigler, Alexandria, Va.

[73] Assignee: World Shelters, Inc., Springfield, Va.

[21] Appl. No.: 577,777

[22] Filed: Sep. 5, 1990

[51] Int. Cl.[5] ..... E04H 12/18

[52] U.S. Cl. ..... 52/646; 52/108; 52/81.3

[58] Field of Search ..... 52/646, 648, 108, 118, 52/645, 81; 135/108

[56] References Cited

U.S. PATENT DOCUMENTS

| | | | |
|---|---|---|---|
| Re. 31,641 | 8/1984 | Derus | 52/109 |
| 563,375 | 7/1896 | Heintz et al. . | |
| 927,738 | 7/1909 | Malaby . | |
| 1,773,847 | 8/1930 | Nickles . | |
| 2,130,919 | 9/1938 | Erickson et al. | 135/108 |
| 2,682,235 | 6/1954 | Fuller | 108/1 |
| 2,781,766 | 2/1957 | Krieger | 135/4 |
| 3,063,521 | 11/1962 | Fuller | 189/34 |
| 3,119,402 | 1/1964 | Bleick | 135/108 X |
| 3,185,164 | 5/1965 | Pinero | 135/4 |
| 3,496,687 | 2/1970 | Greenberg et al. | 52/109 |
| 3,559,353 | 2/1971 | Partridge | 52/63 |
| 3,710,806 | 1/1973 | Kelly et al. | 135/4 R |
| 3,773,061 | 11/1973 | Berger | 135/1 R |
| 3,889,433 | 6/1975 | Eubank, Jr. | 52/86 |
| 3,968,808 | 7/1976 | Zeigler | 135/4 R |
| 4,026,313 | 5/1977 | Zeigler | 135/4 R |
| 4,156,433 | 5/1979 | Beaulieu | 135/4 R |
| 4,241,746 | 12/1980 | Rothe | 135/4 R |
| 4,276,726 | 7/1981 | Derus | 52/109 |
| 4,280,521 | 7/1981 | Zeigler | 135/4 R |
| 4,290,244 | 9/1981 | Zeigler | 5/109 |
| 4,402,544 | 9/1983 | Artim et al. | 296/110 |
| 4,437,275 | 3/1984 | Zeigler | 52/109 |
| 4,473,986 | 10/1984 | Zeigler | 52/645 |
| 4,480,415 | 11/1984 | Truss | 52/108 |
| 4,527,362 | 7/1985 | Tobey et al. | 52/646 X |
| 4,580,375 | 4/1986 | Nodskov et al. | 52/109 |
| 4,599,832 | 7/1986 | Benton et al. | 52/118 |
| 4,641,676 | 2/1987 | Lynch | 135/110 |
| 4,658,560 | 4/1987 | Beaulieu | 52/646 |
| 4,663,899 | 5/1987 | Nodskov et al. | 52/109 |
| 4,689,932 | 9/1987 | Zeigler | 52/648 |
| 4,745,725 | 5/1988 | Onoda | 52/648 X |
| 4,779,635 | 10/1988 | Lynch | 135/97 |
| 4,866,892 | 9/1989 | Satoh et al. | 52/646 X |
| 4,941,500 | 7/1990 | Emard | 135/108 X |
| 5,014,484 | 5/1991 | Tamizawa et al. | 52/645 X |
| 5,036,641 | 8/1991 | Viry | 52/646 |

FOREIGN PATENT DOCUMENTS

| | | |
|---|---|---|
| 82103098.8 | 4/1982 | European Pat. Off. . |
| 222437 | 5/1987 | European Pat. Off. . |
| 2467924 | 4/1981 | France . |
| 2598164 | 11/1987 | France . |

OTHER PUBLICATIONS

Brochure (1989) from International E-Z UP, Inc., Upland, Calif.

*Primary Examiner*—Carl D. Friedman
*Assistant Examiner*—Lan M. Mai
*Attorney, Agent, or Firm*—Merchant, Gould, Smith, Edell, Welter & Schmidt

[57] ABSTRACT

Disclosed is a building system which utilizes structural modules (10) to form a shelter (89, 132) having a spherical surface. The shelter includes flat portions (A) composed of flat modules (7), arch portions (B) composed of cylindrical modules (8), and spherical triangle portions (C) composed of spherical modules (9). The modules (10) are composed of crossed pairs of struts (**13*a*-16*b*) which are hingedly interconnected by hubs (18-25). The structural modules preferably include periphery cables (27-30) and diagonal cables (31, 32, 44, 45), each cable being held in place by a cable keeper member (33-36, 46, 47). The structure also features a locking bar mechanism (26) for maintaining the modules (10) in an expanded configuration, and hubs (114) having radial cutout portions (115**) for accommodating angular distortion of the structural framework.

18 Claims, 12 Drawing Sheets

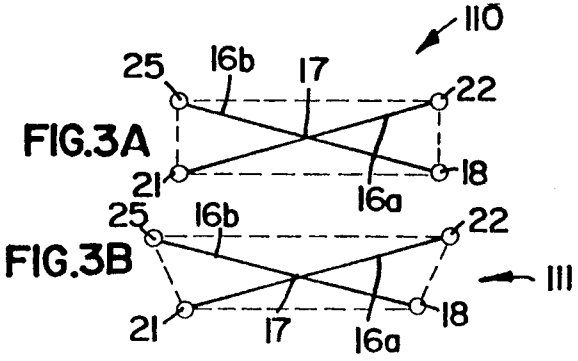
FIG.3A
FIG.3B
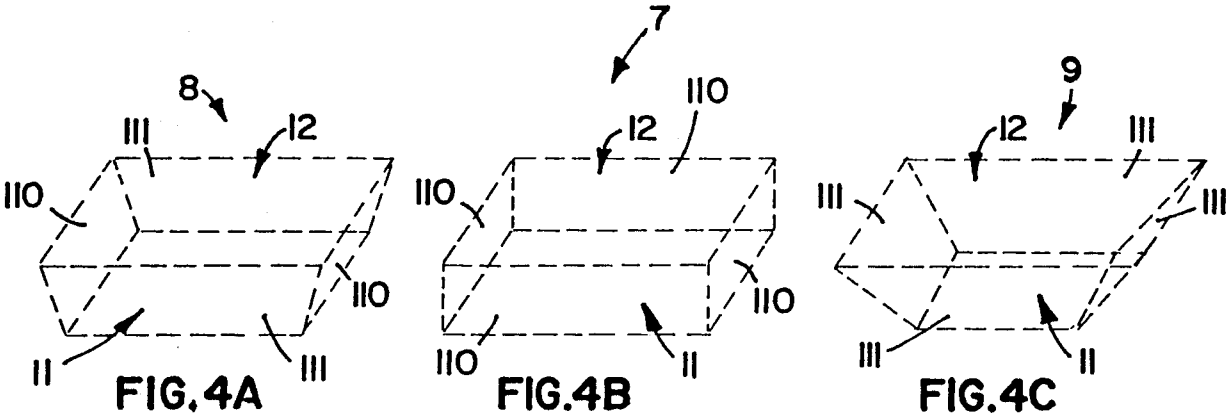
FIG.4C
FIG.4B
FIG.4A

FIG. 10
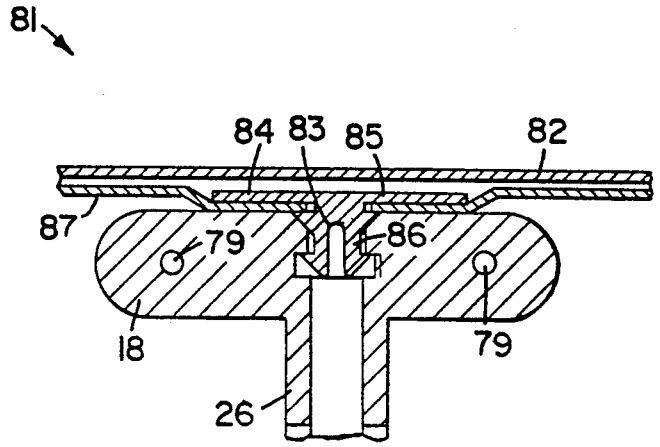
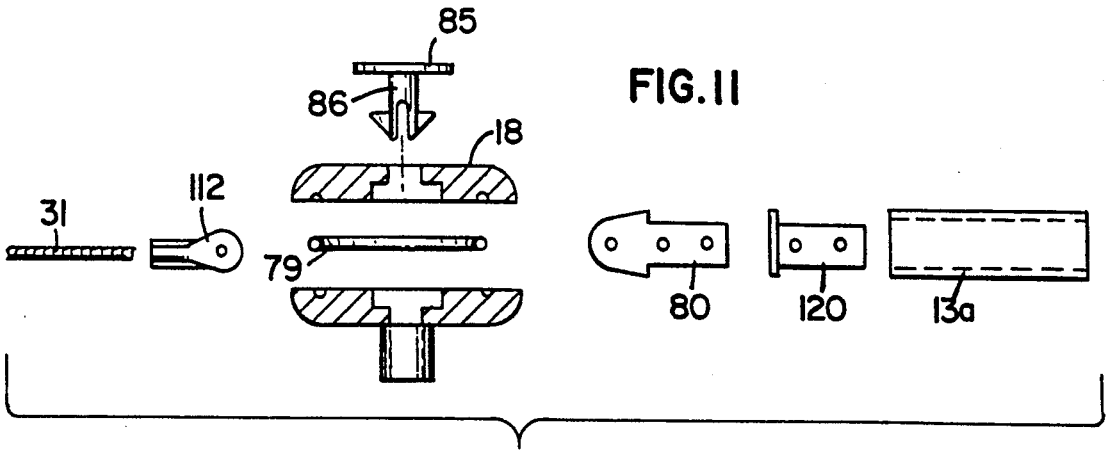
FIG. 11

POLYHEDRON BUILDING SYSTEM

FIELD OF THE INVENTION

The present invention relates to a building system which includes the use of structural modules which form a shelter having a spherical surface, and more particularly to a self-supporting collapsible structure featuring structural modules having rigid locks and reinforcing cables.

BACKGROUND OF THE INVENTION

Building assemblies are known which have a foldable capability so that they may be erected where desired and, when necessary, folded up to a rather compact form for storage and/or transportation. These building structures are based upon column-like elements or rods which are used as basic construction units which function as stays. The links are interconnected with pivot joints, slip joints or other forms of movable interconnects, so that a collapsible, articulated structure is formed. A fabric covering is usually associated with the network of rods. An example of such a collapsible structure is shown in U.S. Pat. No. 3,185,164 which shows a structure including a plurality of rods joined by couplings into groups of three which are inter-related to form a generally hexagonal structural system. Another example of such a collapsible structure is shown in U.S. Pat. No. 3,710,806. Structures which utilize elements intended to maintain the rigidity of the structure are also known, as exemplified in U.S. Pat. No. 3,063,521.

The prior art is also generally cognizant of the use of collapsible frame structures for supporting tents or other outdoor shelters. Examples of collapsible frames for use in supporting such tents or outdoor structures are shown in U.S. Pat. No. 563,376; U.S. Pat. No. 927,738; U.S. Pat. No. 1,773,847; and U.S. Pat. No. 2,781,766. Such structures have varied widely in their ease of erection and storage, and are of varying structural strength.

Structures which are in the form of a dome or sphere are of interest because this shape achieves greater strength than other geometric shapes for the materials used. A dome structure also provides a great deal of interior space with a minimal amount of base area and building materials. However, spherical structures involve complex construction and difficult geometric relationships between the structural members. The complexity increases further when it is desired that the dome structure have a collapsible capability.

Attempts have been made to convert a plurality of flat planes into a spherical surface. Buckminster Fuller defined the spherical icosahedron (i.e., a polygon having 20 faces) by projecting a flat triangular grid onto the surface of a sphere. He utilized a 60 degree coordinate system, based on a triangular shape, which is very structurally stable. Fuller's icosahedron, as disclosed by U.S. Pat. No. 2,682,235, is known as a geodesic dome. However, Fuller's geodesic dome does not have a collapsible capability; rather, it is intended to be constructed by the user at the site of usage. For these reasons, the geodesic dome design is not always a practical structure.

In U.S. Pat. No. 3,968,808, issued July 13, 1976, Theodore Zeigler utilized Fuller's icosahedron in the form of a folding, self-locking structure. No new geometry was introduced. The patent discloses a self-supporting domed shelter constructed from a series of intermeshing pentagonal or hexagonal sections, each section being composed of crossed pairs of pivotally connected struts. The generally semi-spherical framework is made of elongate struts and hub means which are movable between a collapsed, bundled condition (in which the struts are closely bundled and in a generally parallel relationship) and an expanded condition of three-dimensional form. The structural framework as disclosed in this patent is self-supporting by virtue of self-locking action which results from the asymmetrical disposition of certain struts. The framework has zones of sliding connections between crossed struts, as for example at 110 in FIG. 1, which allows the structure to be collapsed.

In Zeigler's U.S. Pat. No. 4,026,313, each icosahedron face has alternate zones 18 and 20 of sliding and pivoted connections as shown in FIG. 1 of that patent. FIGS. 10–12A illustrate rectangular modules. U.S. Pat. Nos. 4,290,244 and 4,437,275 are divisions of U.S. Pat. No. 4,026,313 and are directed to structural modules.

As explained above, Buckminster Fuller converted a flat plane into a spherical surface or compound plane of several axes to form an icosahedron. Theodore Zeigler's later work, as shown for example in U.S. Pat. No. 4,689,932, converted a flat plane into a spherical surface, but in a different manner. Zeigler defined the octahedron shape, which allowed the ability to build long narrow structures or tall wide structures. An octahedron is a solid bounded by eight plane faces. With the octahedron based design, the struts which define the structural modules may be of equal length.

The octahedron design developed by Zeigler also introduced the 90–45 degree coordinate system. This design permits "stretchability" on three axes because each of the modules has the same edge lengths. That is, the controlled addition of modules permits the basic octahedron to be dimensionally increased in three mutually orthogonal directions: in height, in width and in length.

Zeigler's U.S. Pat. No. 4,689,932 employed the above octahedron concept to form a dome structure composed of square modules. This patent is incorporated by reference herein. The patent disclosed two types of modules: a "flat" module and a "transition" or cylindrical module. The circumscribing sides of all the modules are formed by crossed, pivotally connected struts.

With this design, the resulting building has a generally spherical shape which is substantially horizontal at the top of the structure and substantially vertical near the bottom of the structure, there being a curved portion therebetween formed by the transition modules. With this design, the corner portions of the building are left open if, for example, passageways are desired, as shown in FIGS. 1–3 of U.S. Pat. No. 4,689,932. As the size of the structure is increased, these open corner sections become progressively larger. The prior art does not address the problem of completely closing off the corner portions of the octahedron structures.

In regard to prior building designs, including the geodesic dome design and conventional structures such as frame tents, there are several general problems. If the structure is of the expandable/collapsible type, the structures are often difficult to erect, and require several workers, a significant amount of time, and special tools and equipment. The structures are also often complex in construction, having several different detachable parts and being relatively heavy and bulky in size. The non-uniformity of the size of the structural members also contributes to the overall complexity and cost of such structures. Many conventional structures, such as frame tents having a flat roof, are limited in their aesthetic appeal. As a result, the number of applications for which these structures are appropriate is limited.

The present invention addresses these and other problems associated with known collapsible support structures.

SUMMARY OF THE INVENTION

The present invention is a structural unit for a portable shelter framework. The structural unit is composed of elongated struts which are expandable into three-dimensional form and collapsible into a bundled form in which the struts are disposed in a closely spaced, generally parallel relation. According to one aspect of the invention, the inventive structural unit is a spherical module which, when expanded, defines inner and outer parallel faces, each of which are of a rhombus shape but which are of different sizes. The spherical module has two pairs of opposite side faces, each of the side face pairs defining non-parallel planes. Preferably, the module is circumscribed by crossed, pivotally connected struts of equal length. The spherical modules are combinable in an end-to-end relationship with other spherical modules or with cylindrical modules. A cylindrical module also has inner and outer parallel faces which each are of a rhombus shape, with the widths of the inner and outer faces being different and the lengths of the inner and outer faces being the same. That is, one pair of opposite side faces defines two parallel planes; and the other pair of side faces defines two non-parallel planes. The third type of module, the flat module, has parallel inner and outer rhombus shaped faces of the same size. As used herein, the term "rhombus" means a parallelogram with four equal sides and includes a parallelogram with either oblique angles or right angles.

In the preferred embodiment. hub means are provided to pivotally interconnect the struts, and the hub means have a radial cutout portion to accommodate angular distortion of the module's framework. The preferred embodiment of the structural unit also includes locking means for maintaining the modules in an expanded configuration. The locking means preferably is a releasable locking bar consisting of two members which are attached by a snap lock mechanism. According to another aspect of the invention, an expandable/-collapsible structural framework for a portable shelter is disclosed. In the preferred embodiment, the structural framework is formed from a plurality of crossed, pivotally connected elongate struts which define a plurality of modules which are expandable to a three-dimensional form. A preferred embodiment of the structural framework includes a horizontal portion composed of at least one flat module, a plurality of vertical portions, each of which is composed of at least one flat module, a plurality of arch portions between the horizontal portion and vertical portions, each of the arch portions being composed of at least one cylindrical module, and a spherical triangle portion which is composed of at least one spherical module. Preferably, the structural framework is composed of struts of equal length and includes hub means which have angular distortion accommodation means, for example, a radial cutout portion which allows radial movement of the struts with respect to the hub. The preferred structural framework also includes cable members attached to struts or hubs which are organized in position by cable keeper members.

The inventive structural framework may also be formed with less than this number of structural portions. For example, the inventive shelter could be formed with only arch portions and spherical triangle portions; with vertical portions, arch portions and a spherical triangle portion; etc.

According to another aspect of the invention, a structural unit is disclosed which features a plurality of cables interconnected to cable retention means. The cable retention means are preferably cable keeper members, which consist of a strip of material interconnecting a corresponding cable with either a structural rod, another cable or a hub. Two types of cables are included with the present invention, periphery cables and diagonal cables. Various combinations of these cables, as well as the cable keeper members, are included with this invention.

According to another aspect of the invention, a shelter structure is disclosed which comprises a roof structure made of a plurality of modules formed from rod pairs which are interconnected by inner and outer hubs. At least some of the hub pairs are held in an expanded configuration by locking means. The shelter structure features a cover which is sized and configured to correspond to the shape and size of the structure. The shelter structure also includes support means, such as telescoping legs, for raising the roof structure above the ground.

A particular advantage of the present invention is its "stretchability," i.e., the ability to modify the size of the shelter through the simple addition of additional modules. Because the modules have equal-sized strut lengths, the expansion of the size of the structure is greatly simplified. From the structure's basic arrangement, the addition of modules as necessary and desired permits the basic octahedron to be dimensionally increased in three mutually orthogonal directions, i e., in height, in width and in length. The dimensions of the shelter may be controlled individually, that is, the height may be increased without increasing the base dimensions; the base dimensions may be increased without increasing the height; and the base dimensions ma be increased individually (both width and length). In addition, truncated faces of the structures can be positioned side-by-side so as to form a large, continuous shelter structure. Thus, the present invention features improved expandability and combinability. This results in greater design flexibility so as to best meet the particular needs of the user.

Another advantageous feature of the present invention is the balance between the compression forces and tension forces within the structure. Suitable structural members are provided to withstand both compression and tension forces, so as to maintain the building in a structurally stable manner, while at the same time requiring fewer structural members than were required with prior structures. In this manner, the structural strength/weight ratio is increased. The structural stability and strength are increased at least in part by the use of the rigid locks, periphery cables and diagonal cables, as will be explained in more detail below. The structure of the present invention is capable of being built in rather large sizes. The support framework, although lightweight, is structurally stable and resistant to wind forces, etc.

Another advantageous feature of the present invention is the utilization of structural modules which have a "spherical" shape, thereby providing a structural framework capable of curving around the corner portions of the structure. The spherical module allows for curvature of the structure's framework in two orthogonal directions, i.e., in both the width and length directions of the module. The spherical modules allow for a continuous spherical structure without openings proximate the corners of the structure, while at the same time maintaining the structure's collapsible feature. In the preferred embodiment, the spherical module features unique hubs which allow the framework struts' angles relative to each other to vary or deform as necessary according to the size and configuration of the structure.

The present invention is also advantageous because of its modularity and consistency of parts and strut lengths throughout the structure. This uniformity greatly facilitates the manufacturing process and allows the structure to be less complex in construction. The present invention, in the preferred embodiment, employs only a single-sized strut or rod. The struts or rods are crossed and pivotally connected and form the bounding sides of each of the modules.

Yet another advantage of the shelter structure of the present invention is its ease of erection. The structure can be erected quickly by a single person at ground level having no tools. The structure easily expands from a compact, preassembled bundle to a large shelter structure having a rigid self-supporting frame and cover. Regardless of size, the structure can be erected in a matter of minutes. Particular design features which allow the structure to be easily erected are the pivotal interconnection of the frame members, the optional telescoping support legs, and the releasable locking bar mechanism which rigidifies the framework in a quick and convenient manner. For the same reasons, the structure is also easy to collapse when the structure is no longer needed.

The structure is also advantageous in that it is relatively lightweight. In its collapsed position, the structure forms a compact bundle which facilitates transportation and storage. It is easy to handle by even those persons having limited strength or mechanical capabilities. The portable shelter which is the subject of this invention, offers a range of sizes. For example, a portable shelter twenty feet by twenty feet in size collapses to a bundle which is only five feet in length and two feet in diameter, and which weighs only approximately 65 pounds.

There are also a number of specific components of the invention which are also advantageous. The structure employs a waterproof cover which provides protection from the elements. Preferably, the cover is constructed from pieces of material which are sized and configured so as to correspond with the shape and size of the modules, so as to provide for a smooth, taut cover in the expanded mode. The covering material is attached so as to not interfere with the expanding and collapsing functions. The invention features unique cover attachments which securely attach the cover to the roof framework, and which do not interfere with an aesthetically pleasing appearance.

As mentioned above, the structure of the present invention also employs cable members which effectively withstand the structure's tension forces. The cables add only negligible weight to the structure. A related advantageous feature is the structure's cable keeper members, which serve to organize the tension cables of the roof structure and prevent the cables from becoming tangled during the erection or collapsing of the structure. These cable keepers add little weight to the structure, yet they greatly improve the structure's ease of use, thereby making it possible to advantageously employ the structural cables.

The present invention also features convenient support means which may consist of a plurality of telescoping support legs. The support means is interconnected permanently to the roof structure framework, thereby greatly facilitating the collapsing and expanding operations.

Still another advantage of the present invention is the aesthetic appeal of the structure. Particularly for applications in which aesthetics are important, such as parties, trade shows, exhibitions or any other application in the special events industry, the structure provides a modernistic look.

For a better understanding of the invention, and of the advantages obtained by its use, reference should be had to the drawings and accompanying descriptive matter, in which there are illustrated and described preferred embodiments of the invention.

BRIEF DESCRIPTION OF THE DRAWINGS

In the drawings, which form a part of the specification and are to be read therewith, optimum embodiments of the invention are shown, and, in the various views, like numerals are employed to indicate like parts:

FIGS. 3A–3B are schematic side views of the rod configurations utilized with the modules of the present invention;

FIGS. 4A, 4B and 4C are schematic views of the cylindrical, flat and spherical module shapes respectively;

FIG. 10 is a cross-sectional view of the fabric attachment button;

FIG. 11 is an exploded view of the hub, fabric attachment button, cable, and rod assembly;

DETAILED DESCRIPTION OF THE PREFERRED EMBODIMENTS

Figure 1:
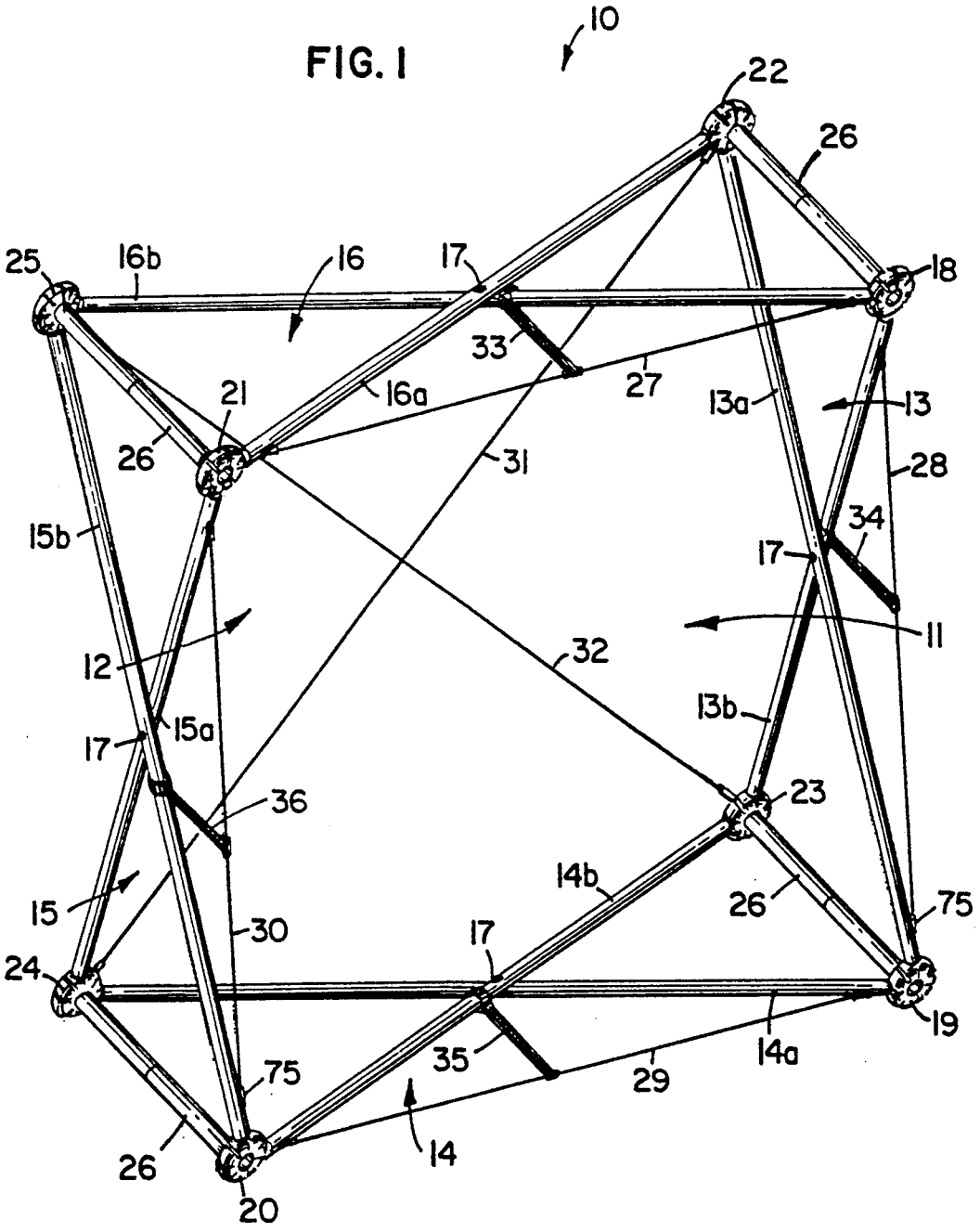
FIG. 1 is a perspective view of a module of the present invention, in its expanded mode.

Referring to FIG. 1, a unit or module 10 according to the invention is shown in its erected condition. The module 10 is formed as a box-like frame and forms a part of a roof or wall structure for a collapsible structure, the details of which are described more fully below. The module 10 has an inner face 11, an outer face 12, and four side faces 13, 14, 15 and 16. Each of the side faces 13, 14, 15 and 16 are defined by two equally long rods designated 13*a* and 13*b* for the side face 13, and in corresponding manner for the remaining side faces 14, 15, 16. Proximate their central points, the rods in each side face 13–16 are pivotally connected in a scissor-like manner at pivot points 17, in the preferred embodiment. Each pivotal connection 17 can be made in any suitable manner, such as by means of pins, rivets or the like. In the preferred embodiment, the rods 13*a*, 13*b*, 14*a*, 14*b*, 15*a*, 15*b*, 16*a*, 16*b* are relatively thin-walled, hollow, aluminum tubes having an external diameter of approximately three quarters of an inch. At the end of each rod is a suitable hub means or corner joint, the inner corner joints being designated 18, 19, 20, 21 and the outer corner joints being designated 22, 23, 24 and 25. The corner joints 18–25 provide a pivotal connection between the rods, and preferably are hinged hubs which consist of steel blade connectors pivoting on a steel ring which is embedded in the hubs. The hubs are made of ABS plastic or other suitable material. In the preferred embodiment, the corner joints 18–25 may be hubs generally of the type described in U.S. Pat. No. 4,280,521, which is incorporated herein by reference.

In this manner, the corner joints 18, 19, 20, 21 at the inner module surface are pivotally connected with the rods 16*b* and 13*b*, the rods 13*a* and 14*a*, the rods 15*b* and 14*b*, and the rods 15*a* and 16*a* respectively. Similarly, the corner joints 22, 23, 24 and 25 at the outer module surface are pivotally connected with the rods 16*a* and 13*a*, 14*b* and 13*b*, 14*a* and 15*a*, and 15*b* and 16*b* respectively.

By combination of the module 10 as shown with a number of similar modules, some of the corner joints 18 to 25 will also be corner joints in one or more adjacent units 10 or, expressed in another way, one or more of the side faces 13 to 16 will be common to two adjacent units.

In order to enable a simple and quick locking in the illustrated erected condition of the unit, a releasable locking device 26, the detailed construction of which is described below, forms a rigid connection for pairs of opposed corner joints at the inner and outer surfaces of the module, such as corner joint pair 18 and 22. The locking bars 26 render the structure 10 self-supporting by interconnecting the inner and outer pairs of hubs when the module 10 is in its expanded configuration.

The module 10 also includes four cables which extend around the periphery of the module's inner face 11, referred to as periphery cables or scissors cables 27, 28, 29 and 30. The cables may extend between the inner hubs 21–18, 18–19, 19–20, and 20–21 respectively. That is, one end of the cables could be connected to one of the hubs instead of being attached to a point along one of the rods. Alternatively, the cables 27 to 30 may extend between the ends of the rod members which are proximate the inner hubs by a suitable attachment mechanism, such as a connector plate 75 which is riveted to the rod. In addition, the module 10 has a pair of diagonal cables 31, 32 which extend between hubs 22–24 and 25–23 respectively. In the preferred embodiment, the cables 27 to 30 and 30, 31 are made of a steel cable. The cable is flexible, so that when the module 10 assumes the collapsed mode illustrated in FIG. 2, the cables 27 to 30 and 31, 32 form loops.

One novel feature of the present invention is cable retention means, in the preferred embodiment consisting of cable keeper members. The cable keepers are indicated in FIG. 1 at 33, 34, 35 and 36, and they serve to retain cables 27, 28, 29 and 30 respectively. The cable keepers 33 to 36 can be made of a flexible or rigid material such as a thin strip of plastic or cloth material. The cable keepers 33 to 36 could be made of a material which has elastic properties. Each cable keeper 33 to 36 is, at one end, attached to its corresponding cable and, at the other end, attached to a corresponding rod at a point proximate to the pivot point 17. In the preferred embodiment, the cable keepers 33–36 are made of flexible plastic tape, the ends of which are adhered to the cable and rod by wrapping the adhesive side around these members. As the module 10 is collapsed, the cable keepers 33 to 36 serve to retain the corresponding cables 27 to 30 in an organized, looped configuration, thereby preventing any problems with tangling and greatly facilitating the process of erection and collapsing of the module 10.

Figure 2:
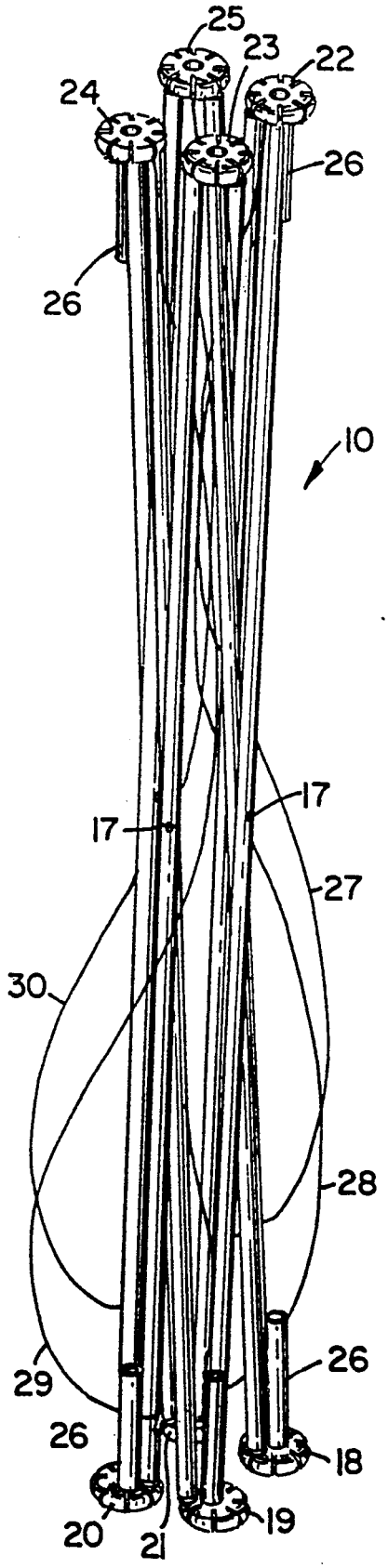
FIG. 2 is a perspective view of the module shown in FIG. 1 in its collapsed mode.

FIG. 2 illustrates the module 10 in its collapsed mode. The detachment of the locking bars 26 allows the crossed pivotally connected rods 13*a*, 13*b*, 14*a*, 14*b*, 15*a*, 15*b*, 16*a*, 16*b* to be pivoted in such a manner so as to bring the inner hubs 18–21 and outer hubs 22–25 in close proximity to one another. The struts 13*a*, 13*b*, 14*a*, 14*b*, 15*a*, 15*b*, 16*a*, 16*b* assume a bundled, substantially parallel relationship, with the flexible cables 27–30 hanging in the looped configuration illustrated in FIG. 2. A rigid lock or locking bar 26 is provided, and the locking bar 26 remains attached to its corresponding hub. In one embodiment, the locking bar 26 is formed by two members which snap lock together, each member being attached to one hub 18 of a hub pair. In this manner, the framework can be collapsed and erected as a single piece, and the lack of detachable pieces greatly simplifies the construction process.

FIGS. 3A and 3B illustrate a pair of crossed struts, which are indicated as 16*a*, 16*b* for purposes of illustration, although the following explanation applies to each scissored pair of struts. As illustrated in FIG. 3A, the struts 16*a*, 16*b* are interconnected at the mid-point of each strut by the pivotal connection 17. With this configuration, the side face 16 has a rectangular shape 110, as is illustrated by the dashed lines in FIG. 3A.

Alternatively, the pivotal connection between the struts 16*a*, 16*b* could be offset somewhat from the struts' center point, as is illustrated in FIG. 3B. In FIG. 3B, the opposite pairs of crossed, pivoted struts 16*a*, 16*b* are asymmetrically disposed with respect to the pivot pins or rivets 17. With this configuration, the side face 16 assumes a trapezoidal shape 111, as is illustrated by the dashed lines of FIG. 3B. In this manner, the span length of the inner face 11 is less than the span length of the outer face 12. The inner face's span length is the distance between the inner hubs 18 and 21, and the outer face's span length is the distance between the outer hubs 22 and 25. The differences between the span lengths, and therefore the degree of curvature, is determined by the position of the pivot point 17. In the preferred embodiment, the lengths of the struts 16*a*, 16*b* are identical throughout the structure.

Three different shapes of modules are illustrated in FIGS. 4A, 4B and 4C: a cylindrical module 8, a flat module 7, and a spherical module 9. For each of the modules 7, 8 and 9, pairs of crossed struts circumscribe the modules, each strut being of a single strut length. In FIGS. 4A–4C the struts 14*a*, 14*b*, 15*a*, 15*b*, 16*a*, 16*b* are not illustrated for purposes of clarity. Rather, the dashed lines in FIGS. 4A–4C illustrate the outer boundaries of each module.

Referring to the flat module 7 of FIG. 4B, each side face of the module 7 has the rectangular shape 110, so that the inner face 11 and outer face 12 are of identical width and length and define parallel planes. In the case of the flat module 7, the inner face 11 and outer face 12 are of the same shape and are preferably square. The flat module 7 is of the same general shape as described in my U.S. Pat. No. 4,689,932.

A cylindrical module 8 is illustrated in FIG. 4A. The cylindrical module 8 is of the same general shape as the transition module described in my U.S. Pat. No. 4,689,932. The inner face 11 and outer face 12 are both of rhombus shape and define parallel planes, but the inner face 11 has a different rhombus shape than the rhombus shape of the outer face 12. That is, the widths of the inner and outer rhombus faces are different, and the lengths of the inner and outer rhombus faces are the same. When a series of cylindrical modules are connected end to end, curvature is achieved in one direction. The cylindrical modules 8 have opposite side faces 111 of trapezoidal shape and opposite side faces 110 of rectangular shape. The trapezoidal side faces 111 define planes which have a parallel relationship, whereas the opposite rectangular side faces 110 define non-parallel planes.

A spherical module 9 is illustrated in FIG. 4C. With this module, the inner face 11 and outer face 12 are both of rhombus shape and define parallel planes, but the width and length of the inner face 11 is less than the width and length of outer face 12. In this manner, the combination of a number of spherical modules 9 achieves curvature in two mutually orthogonal directions to form a concave surface. The four side faces of the spherical module 9 are of trapezoidal shape 111. The four side faces 111 form two pairs of opposite side faces, each pair of opposite side faces defining planes which have a non-parallel relationship. It is to be understood that a spherical module could also be constructed in which the outer face is smaller than the inner face 111, so as to cause curvature in the opposite direction from the dome-shaped structures illustrated herein.

Figures 5A, 5B, 5C, 6A, 6B, 6C, 6D, 6E, 7A, 7B, 7C:
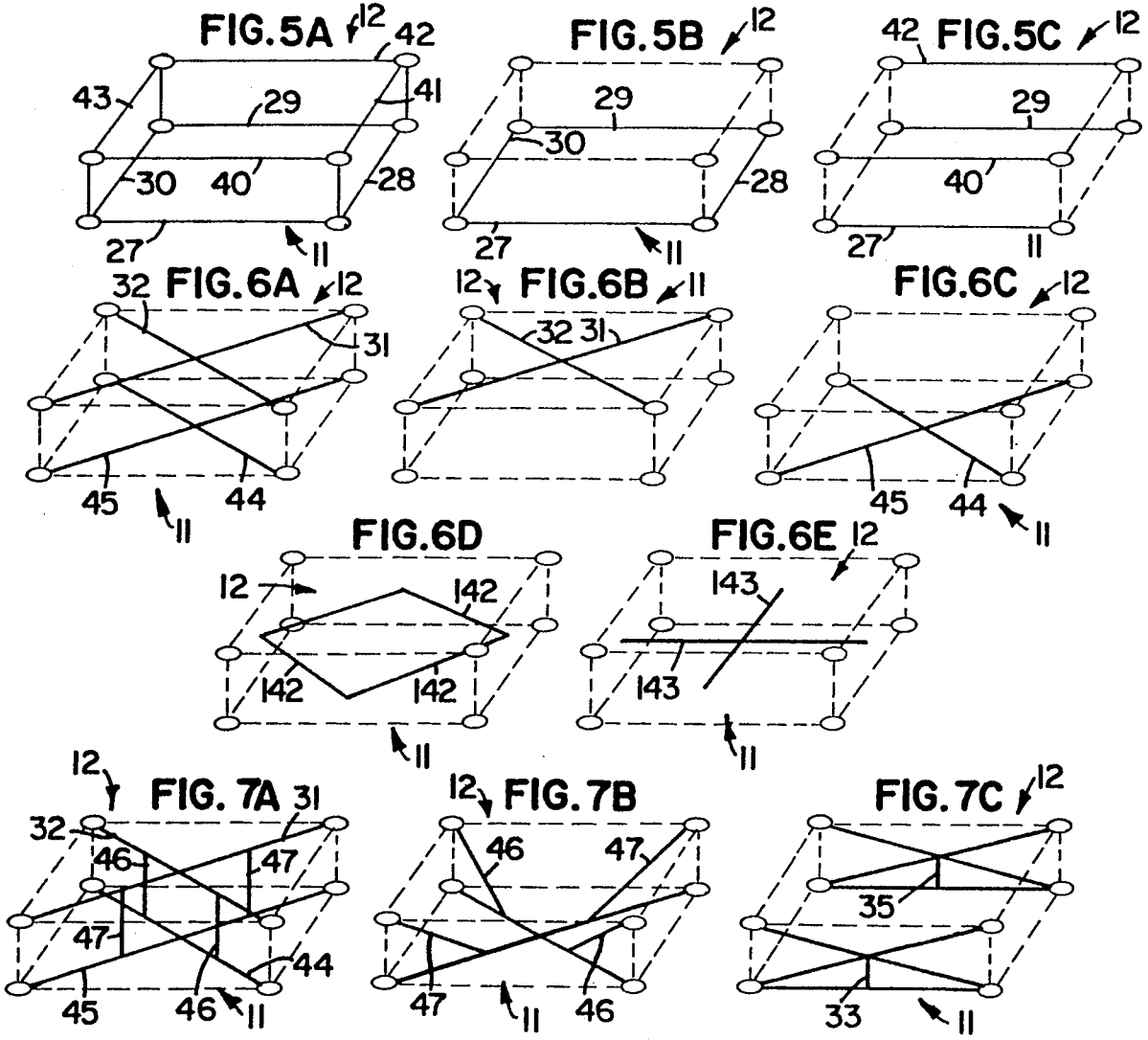
FIGS. 5A–5C are perspective views of the module illustrated in FIGS. 1–2, illustrating various periphery cable designs.
FIGS. 6A–6E are perspective views of the module illustrated in FIGS. 1–2, illustrating various diagonal and intermediate cable designs.
FIGS. 7A–7C are perspective views of the module illustrated in FIGS. 1–2, illustrating various cable keeper design alternatives.

FIGS. 5A–5C and 6A–6E illustrate alternative support cable designs for the modules 10. FIGS. 5A, 5B and 5C illustrate alternative designs of periphery cables, whereas FIGS. 6A, 6B and 6C illustrate various alternative designs of diagonal cables. FIGS. 6D and 6E illustrate intermediate cable designs in which the cable ends are attached proximate the struts' pivot point. Although the schematic drawings of FIGS. 5–7 illustrate flat modules, it is to be understood that the cables and cable keeper designs illustrated therein are equally applicable to the cylindrical and spherical modules 8, 9. It is to be understood that the cables and cable keepers of the present invention could also be utilized with structural modules having a different framework design than that described herein.

In these drawings, the module's inner face is designated as 11 and its outer face is designated as 12. For purposes of clarity, the cables are shown in solid lines, whereas the boundaries of the modules are shown in broken lines; and no rods 13*a*–16*b* are shown for purposes of clarity.

In FIG. 5A, there is illustrated the inner face periphery cables 27, 28, 29 and 30, as well as periphery cables 40, 41, 42 and 43 on the module's outer face 12. FIG. 5B illustrates a design in which periphery cables 27, 28, 29, 30 are provided along the boundary of the module's inner face only. FIG. 5C illustrates the usage of two pairs of parallel periphery cables: cables 27 and 29 on the module's inner face 11, and cables 40, 42 on the module's outer face 12. Thus, the periphery cables may be positioned along the boundaries of either or both the inner face 11 and outer face 12, or may be positioned along only portions of the boundaries of the inner and outer faces 11, 12.

FIGS. 6A–6C illustrate diagonal cables which extend diagonally across the modules. In FIG. 6A, there are outer diagonal cables 31, 32 like those shown in the embodiment of FIG. 1, as well as inner diagonal cables 44, 45. FIGS. 6B and 6C illustrate a pair of outer diagonal cables 31, 32; and a pair of inner diagonal cables 44, 45 respectively. In the cable configurations of FIG. 6A, 6B and 6C, no periphery cables are illustrated. However, a module may be provided with a combination of both periphery cables and diagonal cables. An example of this is the module illustrated in FIG. 1 which features both periphery cables on the module's inner face 11 and diagonal cables on the module's outer face 12.

FIG. 6D illustrates an offset cable design in which the cable ends 112 (see FIGS. 9 and 11) of each cable 142 are attached to the strut 13*a*–16*b* proximate adjacent pivot points 17 (not shown). FIG. 6E illustrates a cross cable design in which the cable connector end 112 on each cable 143 is attached to the struts 13*a*–16*b* proximate opposite pivot points.

In the preferred embodiment, each of the cables 27–32 and 40–45 has its own corresponding cable keeper member. FIGS. 7A–7C illustrate alternative locations for the cable keeper members. As is illustrated in FIG. 7C and FIG. 1, for the inner periphery cables 27–30 and the outer periphery cables 40–43, the cable keepers 33–36 extend from an intermediate point along the cables to an intermediate point along a rod proximate to that cable. As illustrated in FIG. 7A, when there are two pairs of diagonal cables 31, 32 and 44, 45 extending diagonally across the module, the cable keepers 46, 47 preferably extend between the parallel diagonal cables. That is, as illustrated in FIG. 7A, a pair of parallel cable keepers 46 and a pair of parallel cable keepers 47 extend between the diagonal cables 32, 44 and 31, 45 respectively. As illustrated in FIG. 7B, the cable keepers 46, 47 could also extend between the cables and one of the adjacent corner hubs. It is to be understood that alternative positions of the cable keepers, as well as the number of cable keepers, could be easily varied by one skilled in the art within the scope of this invention.

Figure 8:
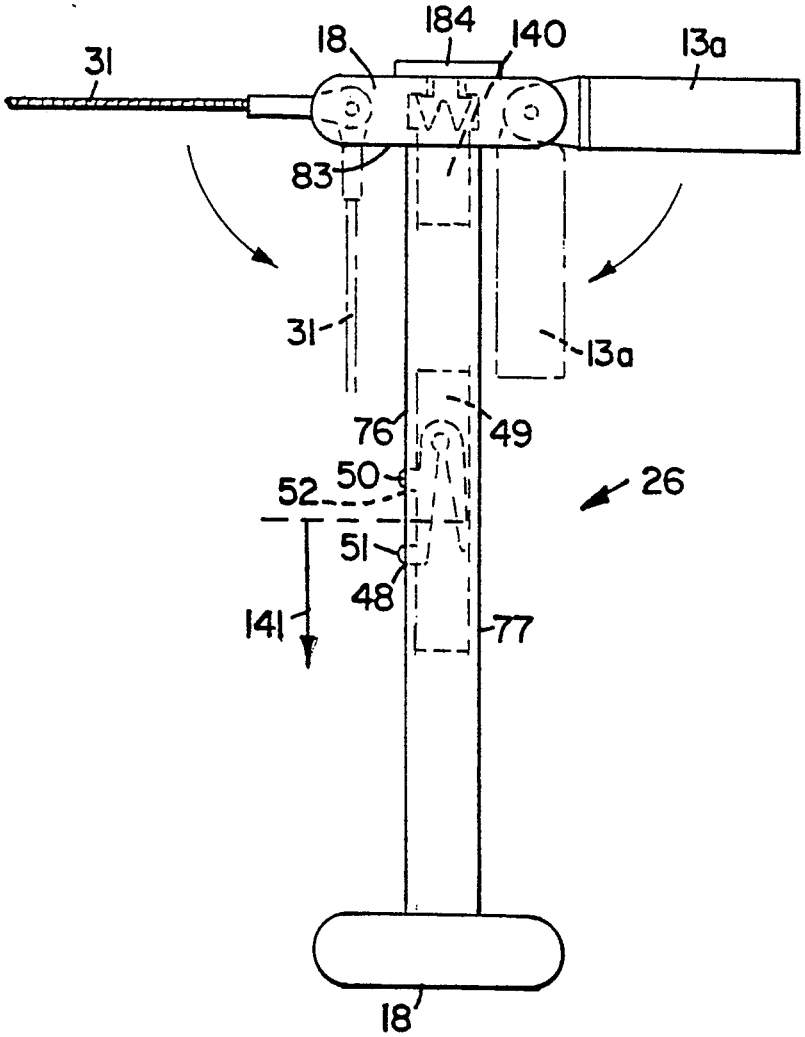
FIG. 8 is a cross-sectional view of the locking bar.

In FIG. 8, the locking device 26 is illustrated in more detail. The locking device 26 consists of two tubular members 76 and 77 secured to the inner side of each of two opposed hubs 18 and designed to slidably engage (as shown by the arrow 141) to fit one into the other. In the preferred embodiment, the tubes 76 and 77 are attached to a central aperture 83 of the hubs by means of an adapter 140 or other suitable attachment means. The locking engagement of the members 76, 77 is accomplished by means of an outwardly biased detent member 48. Preferably, the detent member 48 is positioned on the tube member 49 which is positioned within tube 76. Movement of the detent members 48 is controlled by means of a knob 50. When the tubes 76, 77 are positioned end to end as illustrated in FIG. 8, the detent 48 corresponds with an aperture 51 in the wall of the outer tube 77, and the knob 50 corresponds with an aperture 52. When the member 76, 77 are slidably engaged, the detent 48 snaps into engagement to form a rigid locking bar 26.

As illustrated in the preferred embodiment of FIG. 1, there is a locking device 26 positioned between each opposed pair of corner hubs. As explained above, the corner hubs and locking devices are shared by adjacent modules 10. It is to be understood that fewer than this number of locking devices 26 could be employed to maintain the modules 10 in their erected condition according to the size and shape of the shelter structure.

Figure 9A:
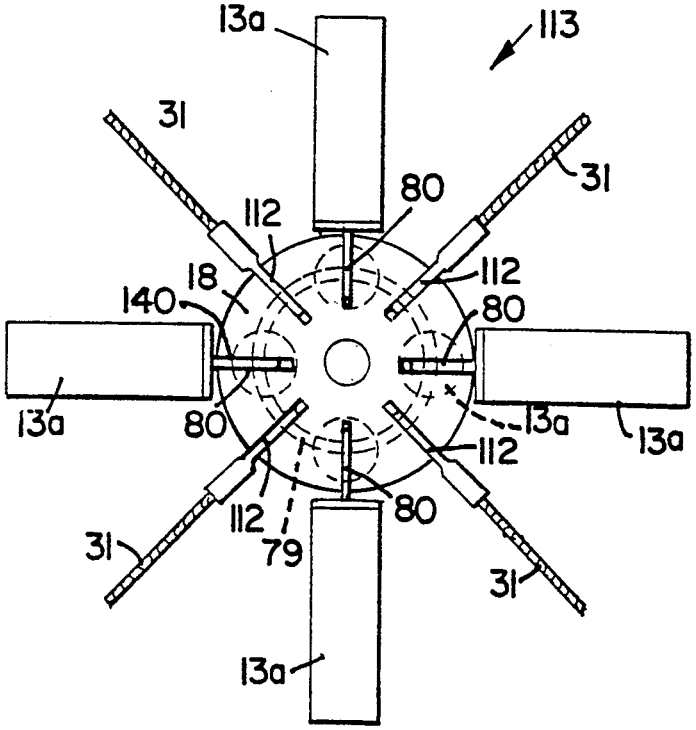
FIGS. 9A–9B are side views of the hubs utilized with the present invention.
Figure 9B:
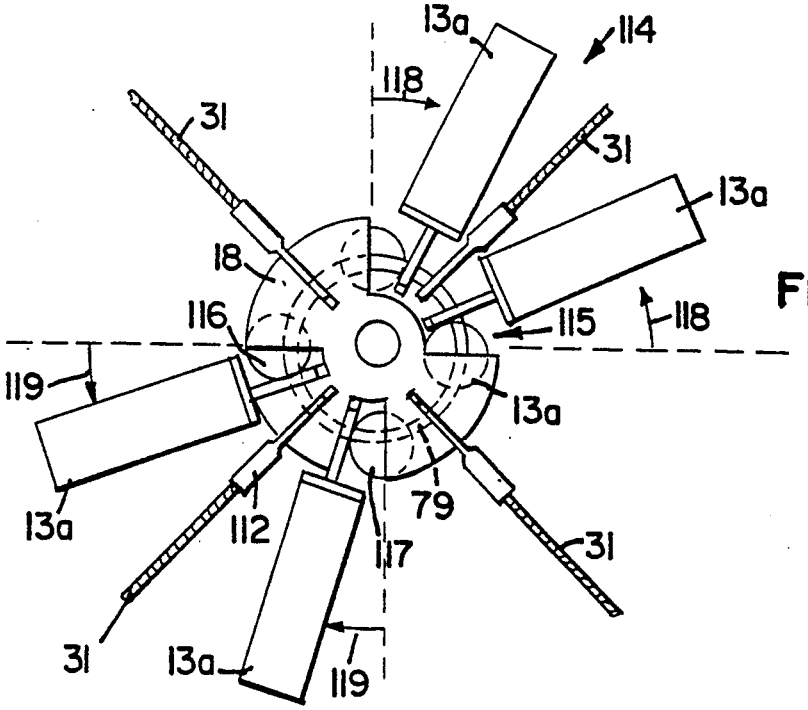

FIGS. 9A and 9B illustrate a detailed view of the hubs 18 to 25. For purposes of clarification in the remaining drawings, the hub body will be referred to as hub 18, rods as 13A, and cables as 31. The hub design illustrated i FIG. 9A is indicated generally as reference numeral 113, and the FIG. 9B design is indicated generally at 114. As disclosed in my prior U.S. Pat. No. 4,280,521, which is incorporated herein by reference, the hub 18 is formed from a pair of disks between which is held a retaining ring 79. The retaining ring 79 pivotally joins the inner ends of the strut's blade members 80 to the hub 18. The ends of the cables 31 are also provided with blades 112 held by the retaining ring 79, in the preferred embodiment in which the cable ends are joined to the hub 18 instead of the rod 13A. The dashed-line circles in FIGS. 9A–9B illustrate the position of the struts 13A when they are folded into their collapsed position. With the hub design illustrated in FIG. 9A, the hub housing has hub slots 140 which are slightly wider than the rod blades 80, so as to provide for a slight amount of clearance which allows for twisting and/or flexure movements of the struts, as well as the pivoting action due to the ring/blade relation. For example, with the two structure embodiments illustrated herein and described below, the hub slot sizes illustrated in FIG. 9A provide sufficient clearance to accommodate for the shape of the spherical modules 9.

With the hub design 114 illustrated in FIG. 9B, the hub body 18 has a plurality of radial cutout spaces 115, 116, 117. The radial cutout spaces 115, 116, 117 allow for radial movement of the module rods 13*a*. The radial cutout 115 spans an arc of approximately 90 degrees. This size of cutout would be capable of handling extreme radial angle changes in the modules. Within that arc are positioned two rods 13*a* and, optionally, a cable 31. The size of the slot 115 allows for radial movement of the two rods 13*a*, as is illustrated by the arrows 118 in FIG. 9B. In the preferred embodiment, the hub 18 also has two slots 116, 117 which accommodate the remaining two rods 13*a*. The arc defined by the slots 116 and 117 is approximately 15 degrees in the preferred embodiment; and each slot 116, 117 accommodates the blade of a single rod 13*a*. In this manner, radial movement of the remaining two rods is permitted, as shown by the arrows 119 in FIG. 9B. The above-sized hub cutouts are presented as a preferred embodiment only, and it is to be understood that different angular sizes of the cutouts 115, 116, 117 could be utilized. The optimal degree of the radial cutouts is determined by the degree of curvature of the shelter wall, and the precise angles could be determined by one of ordinary skill in the art.

The hub design 113 illustrated in FIG. 9A is suitable for utilization in conjunction with modules which do not undergo angular distortion, e.g., at the intersection of two adjacent flat modules 7 or a flat module 7 and cylindrical module 8. The hub design 114 illustrated in FIG. 9B, on the other hand, is suitable for modules which undergo angular distortion from a perpendicular relationship, e.g., proximate the corner portion of the shelter structure where spherical modules 9 are employed. The size and location of the cutouts 115, 116, 117 depends upon the amount of angular distortion of the struts 13*a* and is large enough to accommodate that distortion. For example, the radial angle change of a spherical module 9 is illustrated by the lower right-hand drawing in FIG. 20.

The framework is covered with flexible material to accomplish the shelter function of the invention. When the framework has been expanded to its functionally operative condition, the flexible material is held taut by the framework. In the preferred embodiment, the fabric 82 is attached to the framework at each outer hub 18. FIG. 10 illustrates a cover connector mechanism 81 for attaching a fabric cover 82 to the structure's framework. In the preferred embodiment, the cover 82 is made of a polyester or other suitable material which is treated so as to be waterproof, fire resistent, and ultraviolet resistent.

A cover button 84 having a circular plate member 85 and stem 86 is insertable within the central aperture 83 of the hub 18. In the preferred embodiment, the cover button 84 is made of a plastic or other suitable material, and the stem 86 extends partially into the hub body 18. The fabric patch 87 holds the button 84 to the cover 82. The patch 87, preferably having a circular shape, adheres to the cover 82 by heat sealing or sewing. In this manner, the fabric 82 is attached around the structure framework at each hub 18.

FIG. 11 is an exploded view which illustrates the blades 80, 112 which are utilized with the struts 13A and cables 31 respectively. The outer ends of the blade members 80 are provided with plugs 120 (shown in FIG. 11) received in the ends of the tubular rods 13*a*. Preferably, the blades 80 are interconnected to the struts 13*a* and cables by means of a suitable fastener or by crimping.

Figure 12:
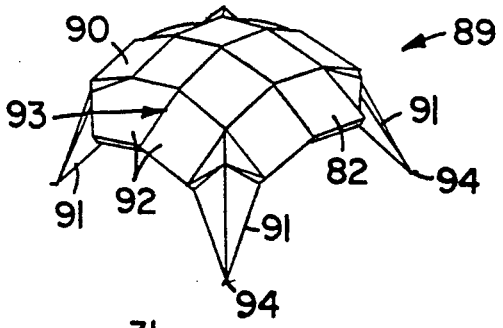
FIG. 12 is a perspective view of the first embodiment's structure.

FIG. 12 illustrates a first embodiment of a shelter structure 89 constructed with the modules 10 of the present invention. The shelter structure 89 has a roof 90 which is supported above the ground by a plurality of support means such as leg assemblies 91, each leg assembly 91 having an anchor foot 94. The structural modules 10 could extend to the ground so as to form the structure's support means, in the event that legs 91 are not utilized. The shelter structure 89 is substantially square in area and symmetrical. In the preferred embodiment, the roof 90 has a domed appearance, i.e., the center of the roof 90 is higher than the roof's outer edges.

The fabric cover 82 extends across the roof's structure remains attached thereto in a manner described above, except for periodic removal for cleaning or other reasons if desired. In the preferred embodiment, the fabric cover 82 consists of a plurality of fabric pieces 92, each of which corresponds to an individual module 10. The pieces 92 are attached along seam lines 93. The edges of the cover 82 are wrapped around the edges of the roof 90 to produce a finished look. Preferably, cables extend between the roof's outer hubs, and the cover 82 extends around these outside cables. The fabric edges are attached to the underside (not shown) of the roof's structure by suitable means such as VELCRO TM hook and loop material.

Figure 13:
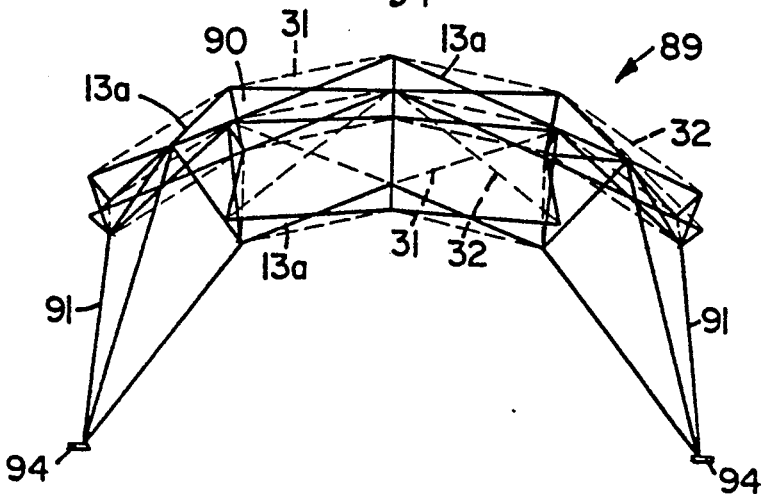
FIG. 13 is a side view of the frame structure for the first embodiment which is illustrated in FIG. 12.
Figure 14:
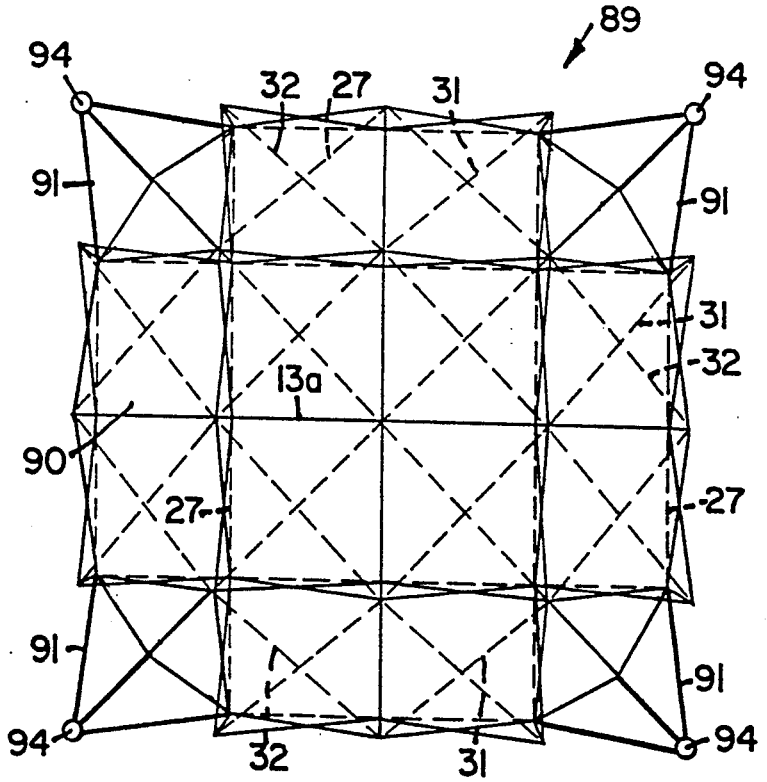
FIG. 14 is a plan view of the frame structure illustrated in FIGS. 12–13.

In the preferred embodiment the rods **13*a*–16*b* are each approximately five feet in length, so that the roof 90 is composed of four modules in each direction, as shown in FIG. 14. That is, for the embodiment illustrated in FIGS. 12, 13 and 14, the area of the shelter structure 89 is approximately 20 feet by 20 feet. The modules 10 are interconnected to each other by sharing adjacent side faces, struts 13*a*–16*b*, hubs 18 and locking bars 26. Each module's inner face forms the underside of the roof structure 90. The modules 10 are maintained in a rigid, erected position by engagement of the locking bars 26 between the hubs 18 in a position which is substantially perpendicular to the plane of the adjacent modules. With the shelter structure 89, each of the modules 10 is a spherical module 9**, as described above.

In FIGS. 13 and 14, the solid lines in the roof 90 illustrate the rods **13*a*–16*b* (which are referred to as 13*a* for purposes of clarity in FIGS. 13 and 14), and the dashed lines in the roof 90 illustrate the diagonal cables 31, 32 and the periphery cables 27–30 (which are referred to as 27 for purposes of clarity in FIGS. 13 and 14). With this type of design, the rods 13*a*–16*b* primarily absorb compression forces, and the cables 27–30 and 31, 32 absorb tension forces. The cabling system illustrated in FIGS. 13 and 14 corresponds with the preferred embodiment described in connection with FIG. 1, although alternative cabling systems could be employed. For example, the diagonal cables 31, 32 could be replaced by a fabric cover 82 which is under tension. With this alternative embodiment, each fabric piece 92 would preferably have diagonal lines of reinforcement (not shown) corresponding to the position of the diagonal cables in FIGS. 13 and 14. These reinforcement lines would preferably consist of strips of tape which are adhered to the fabric cover 82**.

With the embodiment illustrated in FIGS. 12–14, the center point of the roof 90 is approximately twelve feet from the ground, and the leg assemblies 91 are approximately seven feet in height, with the entire structure 89 collapsing to a bundle approximately five feet in length and two feet in diameter.

Figure 19:
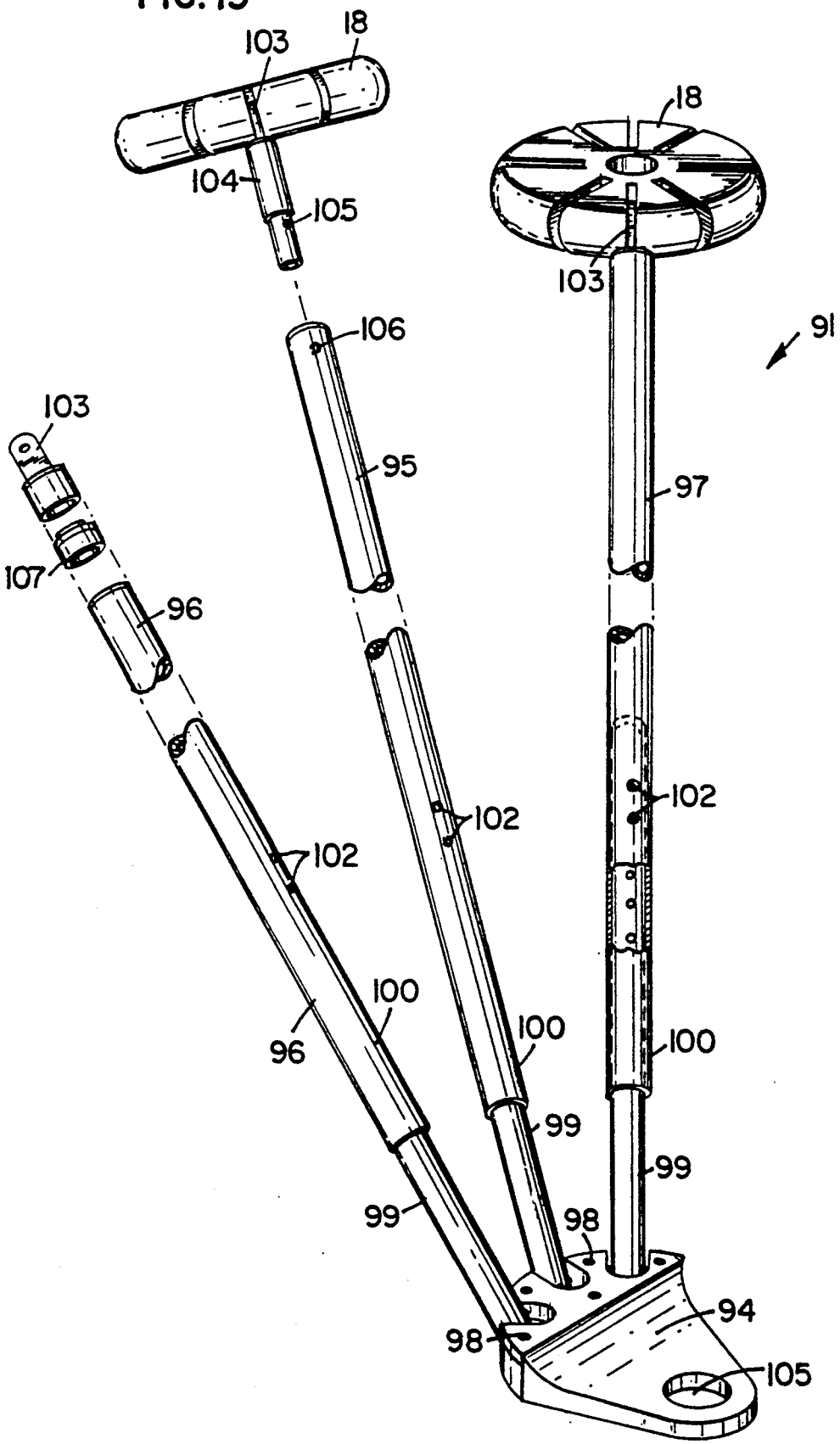
FIG. 19 is a perspective view, partially cut away, of the anchor foot and leg assembly.

The leg assembly 91 is illustrated in more detail in FIG. 19. The leg assembly 91 has a middle leg strut 95 and two outside leg struts 96, 97. The leg struts 95, 96, 97 are hingedly attached to the anchor foot 94 at their bottom end by suitable means, such as a ring and blade connection. The foot 94 has screws 98 for assembly of the leg struts 95, 96, 97 with the foot 94.

Each leg strut 95, 96, 97 consists of two telescoping tubes, an inner tube 99 and an outer tube 100. In their collapsed mode, i.e. when the tube 99 is completely within the tube 100, the leg strut 95, 96, 97 are approximately 5 feet long. In their expanded mode, i.e. when the tube 99 is outside the tube 100, the outer legs 96, 97 are approximately seven feet long and the middle leg 95 is approximately eight feet long.

A snap lock assembly 102 is provided on each leg strut 95, 96, 97 to maintain the legs in their expanded mode. The snap lock assembly 102 consists of a pair of apertures in the wall of the outer tube 100, which cooperate with a pair of detents 102 on the inner tube 99. When the leg struts are positioned in their expanded mode, the detents 102 snap within the apertures to maintain the leg struts in the expanded position. To collapse the leg assembly, the user simply presses the detents 102 to disengage the snap lock assembly.

The upper ends of the outer leg struts 96, 97 have blades 80 (as is shown with the leg strut 96 in FIG. 19) for permanent attachment of each leg strut 96, 97 to a hub 18 along the outer edge of the roof 90. Each blade 80 has an extension portion 151. The upper end of the middle leg strut is not permanently attached to the roof's structure 90. It is removably connected to an attachment tube 104 having a snap lock detent 105 which fits within an aperture 106 on the middle leg 95. The attachment tube 104 is also connected to the hub 18 by means of a blade assembly 80. A cylindrical spacer or adapter 107 is provided to accommodate the different diameter of the blade extension portion 151 (which has an outer diameter of preferably three fourths of an inch) and the diameter of each leg strut 95, 96, 97 or attachment tube 104 (preferably one inch). An exploded view of these members is shown on the left leg 96 of FIG. 19, and it is to be understood that a similar arrangement is utilized at the upper end of leg strut 97 and at the upper end of attachment tube 104.

The foot 94 has a hole 105 for accommodating a stake (not shown) which secures the foot structure 94 to the ground. Use of the ground stakes provides additional structural stability to the shelter structure 89 against wind forces. Guy wires could also be provided for additional structural stability, if desired.

Figure 15A:
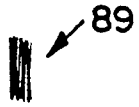
FIGS. 15A–15G are perspective views of the frame of the first embodiment illustrated in FIG. 12, illustrating its deployment steps.

FIGS. 15A–15G illustrate the deployment steps for the shelter structure 89. The shelter structure 89 is shown without the cover 82 for purposes of illustration, although the cover 82 would preferably be attached to the roof framework. As shown in FIG. 15A, the shelter structure 89 is a collapsed bundle of approximately five feet in length. Each of the rods **13*a*–16*b* and legs 91 are in a substantially vertical position, with the hubs being at the upper and lower ends of the bundle. The collapsed framework is maintained as a bundle by use of suitable cord or rope, and a container (not shown) may be provided for facilitating the storage and transportation of the shelter structure 89**.

Figure 15B:
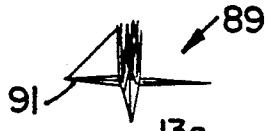
Figure 15C:
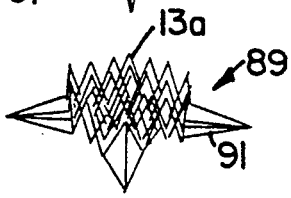
Figure 15D:
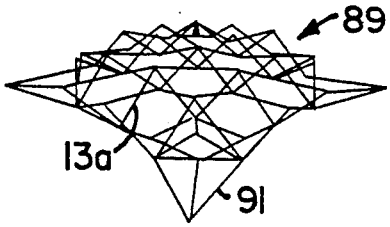
Figure 15E:
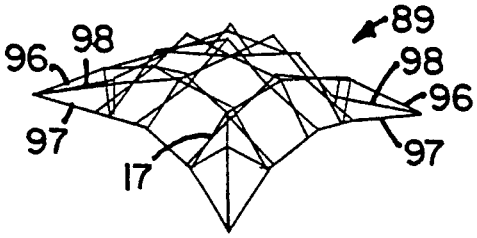

The four leg assemblies 91 are moved downward as shown in FIG. 15B, i.e., so that the three leg struts 95, 96, and 97 of each leg assembly 91 rest upon the ground in a horizontal position. (The fourth leg assembly 91 is not shown in FIG. 15). The next step is raising the middle leg strut 95 from its horizontal position to an inclined position by attaching the inner end of the middle leg strut 98 to the roof structure 90, as is described above. As shown in FIG. 15C, the roof framework 90 is then expanded by pulling the structure outwardly and evenly along the ground, so as to rotate the rods **13*a*–16*b* about their pivot point 17. Eventually, as is shown in FIG. 15D, the structure is pulled to its outermost position, and the modules 10 are locked into position by connecting the locking bars from the underside of the roof structure 90. Preferably, the user first engages the locking bars in the central part of the roof structure and then works outwardly in circular fashion until all of the locking bars are engaged. The locking bars maintain the modules 10 in their erected position, so that the roof structure 90** is self-supporting.

Figure 15F:
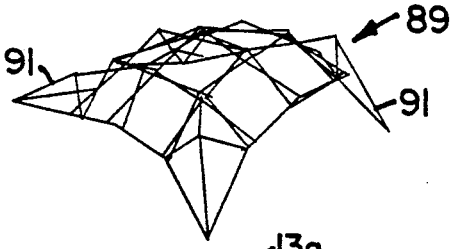
Figure 15G:
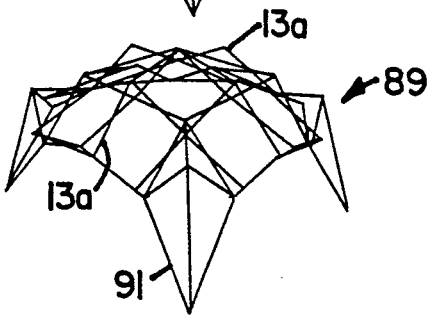

The roof structure 90 is then raised above the ground by expanding the telescoping middle leg strut 95 which automatically causes the middle leg strut 95 to snap lock. In this expanded position, the snap lock assemblies 102 on leg strut 95 engage. It is possible to raise the leg assemblies 91 either separately or simultaneously. FIG. 15F illustrates the leg assembly 91 on the right side of the drawing in its raised position, with the leg assembly 91 on the left side of the drawing still being in its downward position upon the ground. When each of the leg assemblies 91 has been raised, the shelter structure 89 assumes the erected position illustrated in FIG. 15G. As a final step, the support feet 94 are secured to the ground by stakes.

Figure 20:
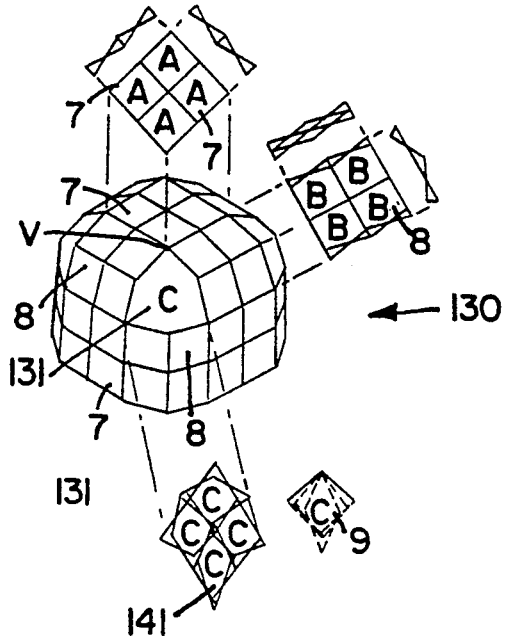
FIG. 20 is a perspective view of an octahedron, with exploded schematic views of modules.

FIG. 20 illustrates a spherical octahedron 130. The octahedron 130 has three different surfaces designated as surfaces A, B and C: a flat plane portion, a cylindrical portion and spherical triangle portion. The horizontal flat portion A, as well as the vertical portions along the four walls of the octahedron 130 are composed of flat modules 7. The cylindrical portion B is composed of cylindrical modules 8, which form a transition surface between the horizontal and vertical flat plane portions. The spherical triangle portion 131 of the octahedron 130 consists of spherical modules 9. Although FIG. 20 illustrates each flat plane portion, cylindrical portion and spherical triangle portion as being composed of a plurality of modules, the cylindrical and flat portions each could also be composed of only a single module. In addition, the modularity of the present invention allows additional modules beyond those illustrated in FIG. 20 to be added in order to form a larger structure. Similarly, the structural portions A, B or C could be eliminated to form a structure of different size or shape.

In the embodiment illustrated in FIG. 20, the spherical triangle surface C has four spherical modules 9. On each side of the spherical triangle portion 131, (i.e., to the left and right of the spherical triangle as viewed in FIG. 20) there are cylindrical modules 8. The cylindrical modules 8 extending between the flat horizontal portion A and the vertical portions form an arched portion of the structure 130. Below the spherical triangle portion 131, there are also cylindrical modules 8 which have curvature in the opposite direction from the curvature of the aforementioned cylindrical modules. With the embodiment illustrated in FIGS. 16–18, the bottom spherical module 141 in the spherical triangle portion 131 is not present, there being in its place the upper end of the corner leg assembly 91.

The vertex of the spherical module portion 131 is indicated by the designation V, and is formed at the corner point of the intersecting arch portions. The angle at the vertex point of the spherical triangle is less than 90 degrees, with the vertex angle varying depending upon the amount of curvature and size of the structure 130.

Figure 16:
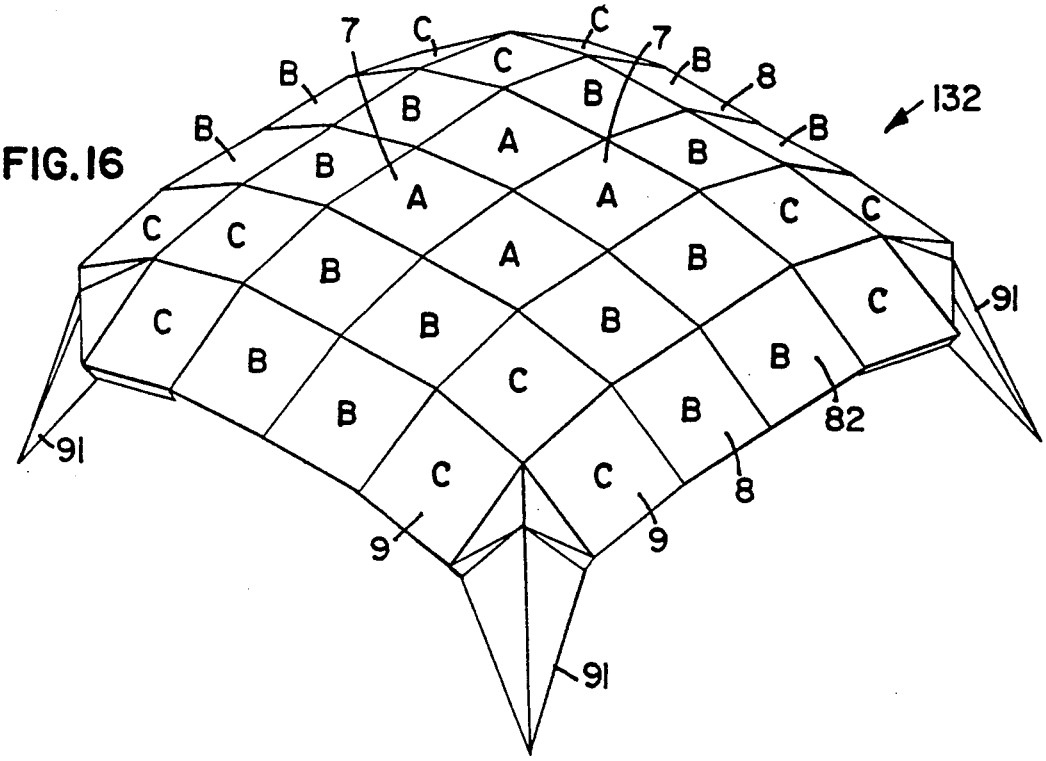
FIG. 16 is a perspective view of the second embodiment's structure.
Figure 17:
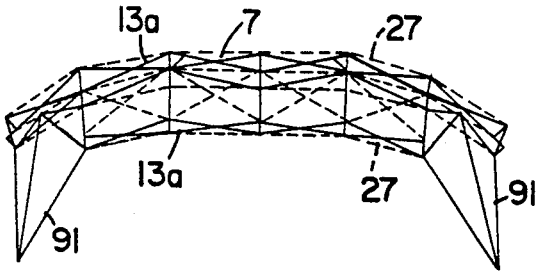
FIG. 17 is a side view of the frame structure for the second embodiment illustrated in FIG. 16.
Figure 18:
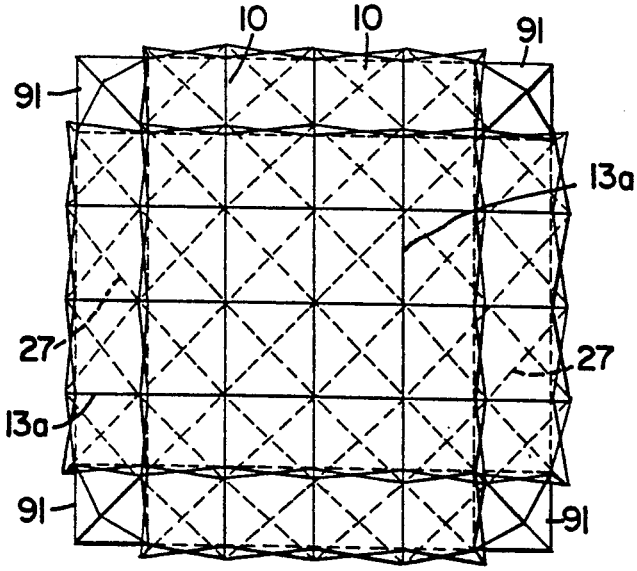
FIG. 18 is a plan view of the frame structure illustrated in FIGS. 16–17.

FIGS. 16–18 illustrate a second embodiment of a shelter structure 132. Like the embodiment of FIGS. 12–14, the structure 132 has a roof 90, leg assemblies 91, and a fabric cover 82. Whereas the structure 89 illustrated in FIGS. 12–14 was composed of four modules in each direction, the structure 132 of FIGS. 16–18 has six modules in each direction. In the preferred embodiment, the strut length 13*a*–16*b* for the modules 10 are approximately five feet in length, so that the shelter structure 132 is approximately thirty feet by thirty feet.

As discussed above with the previous embodiment, the modules 10 are interconnected to each other by sharing adjacent side faces, hubs 18 and locking bars 26. In FIGS. 17 and 18, the solid lines illustrate the rods 13*a*, and the dashed lines illustrate the cables 27. In FIG. 16, a flat portion A composed of flat modules 7, a cylindrical portion B composed of cylindrical modules 8, and a spherical triangle portion C composed of spherical modules 9 are illustrated.

A novel feature of the present invention is its stretchability or expandability, which is evident from a comparison of the first shelter 89 (illustrated in FIGS. 12–14) and the second shelter 132 (illustrated in FIGS. 16–18). The larger shelter 132 is achieved simply by the addition of two module lengths in each direction. In other words, four flat modules 7 are added at the central top portion of the structure 132, and four cylindrical modules 8 are added to the central portion of each of the four sides of the structure 132. In this manner, shelter structures of a myriad of different sizes and shapes can be constructed by the controlled addition of modules. Thus, the modularity of the present invention results in a building system which is less complex in construction, easier to manufacture, and extremely flexible in its applications.

Figure 21:
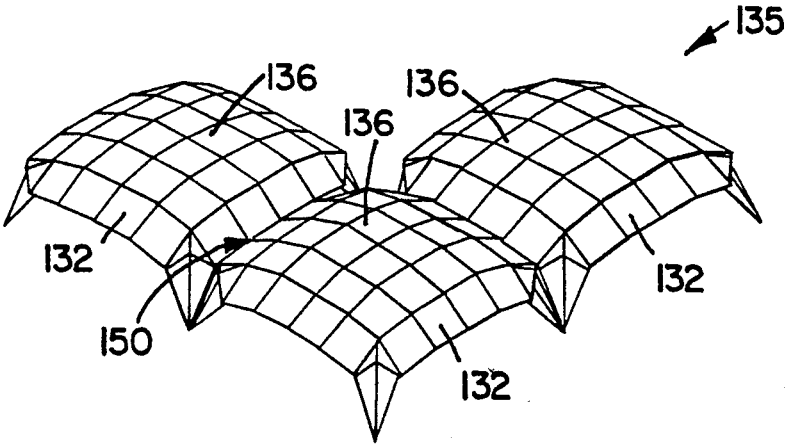
FIG. 21 is a perspective view of a combined shelter structure.

FIG. 21 illustrates a shelter structure 135 which results from a combination of a plurality of free-standing structures, in this case three shelter structures 132 of the type described above. A novel feature of the present invention is that the structures 132 can be placed side-by-side for a combined, larger structure. The straight edge truncation ability of the structures 132 allows for this combinability feature. That is, adjacent structures 132 are truncated along line 150 for a flush abutment of the shelters.

The invention is particularly applicable to shelter structures over a range of sizes; however, the invention has other applications such as folding walls, floors, ceilings and towers.

Even though numerous characteristics and advantages of the invention have been set forth in the foregoing description, together with details of the structure and function of the invention, the disclosure is illustrative only, and changes may be made in detail, especially in manners of shape, size, and arrangement of parts, within the principles of the invention, to the full extent indicated by the broad, general meaning of the appended claims.

What is claimed is:

1. A structural unit, comprising:

(a) four pairs of rods which are pivotally interconnected proximate their center points, the ends of which are hingedly interconnected to each other;

(b) a plurality of flexible cables each having two ends, each of said cable ends being attached to one of said rods; and (c) retention means for holding said cables, said retention means being connected to said cable at an intermediate point along said cable.

2. The structural unit according to claim 1, wherein said cable keeper member is a flexible strip of material, a first end of which is operatively attached to an intermediate point along one of said rods, and a second end of which is operatively attached to an intermediate point along one of said cables.

3. The structural unit according to claim 2, wherein said rods define an inner face and an outer face, and including an inner periphery cable which extends around at least a portion of the periphery of said inner face.

4. The structural unit according to claim 1, wherein the ends of said rods are attached to a hub, said hubs forming pairs of inner and outer hubs, at least some of said pairs of hubs being interconnected by means of locking means.

5. The structural unit according to claim 4, wherein said locking means comprise a locking bar.

6. The structural unit according to claim 5, wherein said locking bar comprises two tubes which are slidably engagable and attached by means of snap lock means.

7. A structural unit, comprising:

a) four pairs of rods which are pivotally interconnected proximate their center points, the ends of which are hingedly interconnected to each other by means of a hub, said hubs forming pairs of inner and outer hubs, at least some of said pairs of hubs being interconnected by locking means, wherein said rods define an inner face and an outer face of said unit;

b) four inner periphery cables which extend around the periphery of said inner face;

c) four cable keeper members, a first end of which is operatively attached to an intermediate point along one of said rods, and a second end of which is operatively attached to an intermediate point along one of said cables.

8. The structural unit according to claim 7, further comprising a pair of diagonal cables which extend diagonally across one of said inner or outer faces.

9. The structural unit according to claim 7, wherein each of said rods is of equal length.

10. The structural unit according to claim 7, wherein said structural unit is end connected to another structural module.

11. The structural unit according to claim 10, wherein said rods are interconnected by hubs having a radial cutout portion.

12. The structural unit according to claim 7, wherein said locking means comprises a releasable locking bar which extends between a pair of said inner and outer hubs.

13. A structural unit, comprising:

(a) four pairs of rods which are pivotally interconnected proximate their center points, the ends of which are hingedly interconnected to each other by means of a hub, said hubs forming pairs of inner and outer hubs, at least some of said pairs of hubs being interconnected by locking means, wherein said rods define an inner face and an outer face of said unit;

(b) a pair of diagonal cables which extend diagonally across one of said inner or outer faces; and (c) cable retention means for holding said cables, said retention means being connected to said cable at an intermediate point along said cable.

14. The structural unit according to claim 13, further comprising a periphery cable which extends around the periphery of said inner face.

15. The structural unit according to claim 13, wherein each of said rods is of equal length.

16. The structural unit according to claim 13, wherein said structural unit is end connected to another structural module.

17. The structural unit according to claim 16, wherein said rods are interconnected by hubs having a radial cutout portion.

18. The structural unit according to claim 13, wherein said locking means comprises a releasable locking bar which extends between a pair of said inner and outer hubs.

* * * * *

UNITED STATES PATENT AND TRADEMARK OFFICE

CERTIFICATE OF CORRECTION

PATENT NO. : 5,230,196

DATED : July 27, 1993

INVENTOR(S) : Theodore R. Zeigler

It is certified that error appears in the above-identified patent and that said Letters Patent is hereby corrected as shown below:

In Column 4, line 41, "ma be" should read --may be--.

In Column 11, line 15, "member" should read --members--.

In Column 11, line 30, "i" should read --in--.

In Column 13, line 64, "strut" should read --struts--.

Signed and Sealed this

Seventh Day of June, 1994

*Attest:*

Bruce Lehman

BRUCE LEHMAN

*Attesting Officer*

*Commissioner of Patents and Trademarks*